United States Patent [19]

Simon

[11] Patent Number: 4,549,052

[45] Date of Patent: Oct. 22, 1985

[54] COOLING SYSTEM FOR AN INDUCTION COOKING CARTRIDGE

[75] Inventor: Donald J. Simon, Indianapolis, Ind.

[73] Assignee: The Maytag Company, Newton, Iowa

[21] Appl. No.: 570,288

[22] Filed: Jan. 12, 1984

[51] Int. Cl.[4] ..... H05B 6/12; F24C 15/10

[52] U.S. Cl. ..... 219/10.49 R; 219/10.67; 219/460; 219/447; 126/37 A

[58] Field of Search ..... 219/10.49 R, 10.67, 219/10.75, 460, 462, 447, 444, 400; 126/37 A, 39 H, 39 N, 39 J, 39 K, 299 D, 21 A; 99/DIG. 14, 340

[56] References Cited

U.S. PATENT DOCUMENTS

| | | | |
|---|---|---|---|
| 2,446,666 | 8/1948 | Thompson | 219/460 |
| 3,167,638 | 1/1965 | Hornaday, Jr. et al. | 219/460 X |
| 3,797,375 | 3/1974 | Cerola | 99/340 |
| 4,191,875 | 3/1980 | Cunningham | 219/10.49 R |
| 4,415,788 | 11/1983 | Field | 219/10.49 R |
| 4,431,892 | 2/1984 | White | 219/10.67 X |
| 4,490,596 | 12/1984 | Hirai | 219/10.49 R |

FOREIGN PATENT DOCUMENTS

| | | | |
|---|---|---|---|
| 52-62745 | 5/1977 | Japan | 219/10.49 R |
| 53-62244 | 6/1978 | Japan | 219/10.49 R |
| 430984 | 8/1967 | Switzerland | 219/460 |

OTHER PUBLICATIONS

Article from IEEE Transactions on Industry Applications, vol. IA-9, No. 1, Jan./Feb., 1973, pp. 81-85.

*Primary Examiner*—Philip H. Leung
*Attorney, Agent, or Firm*—Richard L. Ward

[57] ABSTRACT

An induction cooking cartridge is disclosed which includes an internal fan for cooling the various induction heating components. The cooking cartridge is constructed so that a unique airflow path is defined with cooling airflow entering the mounting recess in at least two areas and entering the cartridge cavity at the bottom and at the top. The airflow is directed over the induction heating circuitry for cooling it and then is exhausted through the fan to an exhaust conduit which surrounds the exhaust opening and conducts the exhaust air to the kitchen environment.

7 Claims, 5 Drawing Figures

COOLING SYSTEM FOR AN INDUCTION COOKING CARTRIDGE

BACKGROUND OF THE INVENTION

This invention relates generally to the field of interchangeable cooking cartridges for use in a free-standing or built-in cooking appliance. The invention relates more particularly to an airflow system for cooling the internal components of a cooking cartridge.

In the field of magnetic induction cooking an induction coil is located below the cooktop surface and is used to generate an oscillating circular magnetic field. When an iron-based cooking utensil is placed in the magnetic field, it acts as a shorted transformer secondary which is subject to a high induction current at low voltage. The cooking utensil is heated directly without heating the cooktop surface first and the heat from the cooking utensil cooks the food, not the induction field, since heat is generated in the utensil which itself becomes the burner.

Because of the heat generated by the induction coil and the electronic circuitry for operating the induction coil, which are both located below the cooking surface within the cooking cartridge, it is necessary to provide some form of cooling for the induction coil and its associated circuitry.

Prior art has shown electric fans operable for moving a cooling airflow over the various components which are to be cooled. U.S. Pat. No. 4,191,875 issued to Cunningham on Mar. 4, 1980, is specifically directed toward controlling operation of an internal electric fan for cooling induction heating apparatus. A thermistor is located near the induction heating apparatus and controls operation of the fan. The thermistor, in the preferred embodiment, is in series with a variable resistor and a capacitor. When the capacitor is charged to a predetermined voltage through the thermistor and variable resistor it will fire an SCR through a diac to allow current to flow through the SCR and operate the fan motor. Cunningham shows a plurality of air inlet and outlet holes in the walls of the housing so that the fan randomly pulls air in one side and exhausts out the other side of the housing after passing over the induction heating apparatus.

U.S. Pat. No. 4,415,788 issued to Field on Nov. 15, 1983, teaches an induction cartridge having a forced air cooling system where a fan draws air into the cartridge cavity, circulates it around the induction heating components and exhausts it out an opening in the bottom of the cartridge. The patent discloses exhausted air being returned to the kitchen environment through an exhaust gap around the periphery of the cartridge between the housing top and the bottom of a support flange.

The prior art has thus recognized the need for cooling induction heating components and has shown particular circuitry utilizng a thermistor for controlling operation of an air moving fan responsive to the temperatures generated within a housing containing these components. There has also been shown a particular airflow path whereby an internal fan draws cooling air directly into a cooking cartridge, across the induction heating components, out an opening in the bottom of the cartridge and exhausts the heated air above the range surface through a gap all around the cartridge between a support flange the range surface. There has been no known showing, however, of a modular cooking cartridge where the internal fan draws cooling air into the interior of the cooking cartridge through the cartridge top, over the induction heating components and out through exhaust openings in the cartridge top by way of an airflow path including an opening in the cooking cartridge container and an exhaust conduit formed by the cartridge container and an axuiliary housing fixed to the container.

SUMMARY OF THE INVENTION

It is therefore an object of the instant invention to provide an improved cooling system for an induction cooking cartridge.

It is a further object of the instant invention to provide a cooling system for an induction cooking cartridge having a cartridge-top inlet and outlet airflow system.

Briefly, the instant invention achieves these objects in a modular cooking cartridge adapted for installation in an upwardly opening recess formed in the cabinetry of a cooking appliance. An enclosure includes a top, a bottom wall and side walls defining a cavity. The cavity contains electrical heating apparatus. The enclosure further includes a support flange which extends substantially around the periphery of the enclosure for supporting the modular cooking cartridge in an operative posture at least partially within the recess. A plurality of airflow ports are generally associated with the enclosure top and communicate with an airflow path into the cavity for cooling the electrical heating apparatus. An air outlet system includes an outlet opening from the cavity, a housing which is cooperable with the outlet opening and the walls of the enclosure to form an exhaust conduit for conducting heated exhaust air, and an outlet port through the enclosure top for conducting the exhaust air to ambient. A fan is associated with the outlet opening and is operable for drawing cooling air into the cavity by way of the airflow path, into cooling contact with the electrical heating apparatus and exhausting through the air outlet system.

Operation and construction of the cooling system for the cooking cartridge and further objects and advantages thereof will become evident as the description proceeds and from an examination of the accompanying three sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
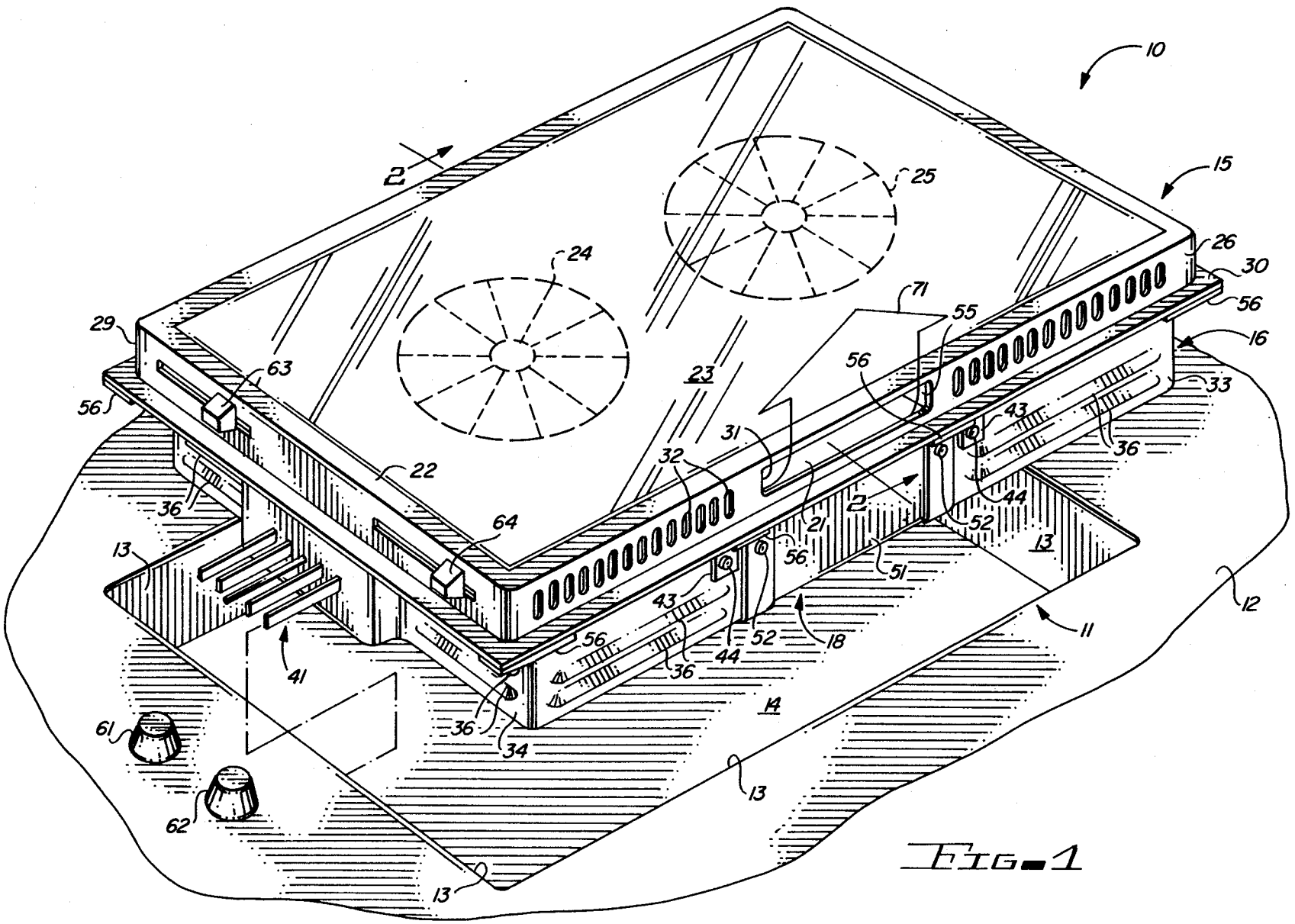
FIG. 1 is an exploded view of an induction cooking cartridge being inserted into the recess of a range top.
Figure 2:
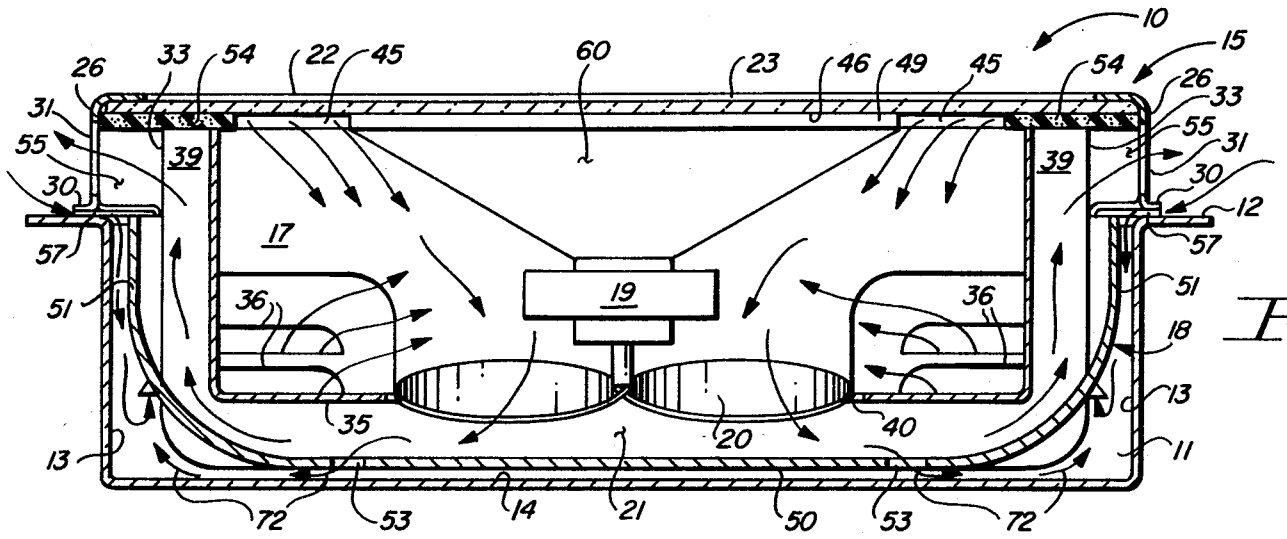
FIG. 2 is a section view taken generally along lines 2—2 of FIG. 1 and showing the induction cooking cartridge in the recess of the range.
Figure 3:
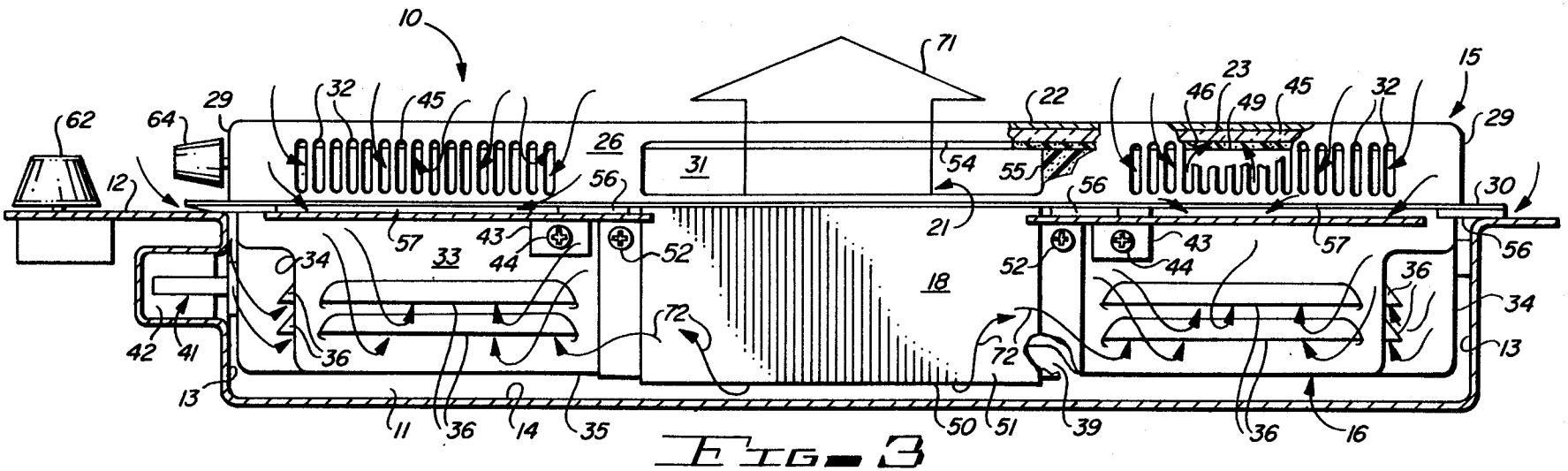
FIG. 3 is a side view of the induction cooking cartridge shown within the recess of the range.

Referring now to the drawings and in particular to FIGS. 1–3, there is shown an induction cooking cartridge 10 which is adapted to be selectively received in a recess 11 formed in the top surface 12 of the housing or cabinet of a free-standing or built-in cooking range. As best shown in FIG. 1 the recess 11 is upwardly opening and includes side walls 13 and a bottom wall 14.

The induction cooking cartridge 10 shown in FIGS. 1–3 has three main components which include a top portion 15, a pan-like upwardly opening container 16 and a panel or housing member 18 which combines with the top portion 15 and container 16 to form an exhaust duct 21. The pan-like container 16 defines a cavity 17 for mounting induction heating components 19 and 60 and a fan 20.

The top portion 15 of the induction cooking cartridge 10 includes a frame-like member 22 for mounting a ceramic or glass cooking surface 23 which, as shown in FIG. 1, has the locations of the induction heating coils generally outlined in dashed lines at 24 and 25. The frame-like member 22, in the preferred embodiment, includes generally vertical side and end walls 26 and 29 which extend downwardly from the cooking surface 23 and terminate in a substantially horizontally disposed support flange 30 extending outwardly from the side and well 26 and 29 around the periphery of the induction cooking cartridge 10. Each side wall 26 includes a rectangular opening 31 generally centered on the front-to-back length of the side wall 26 and a plurality of smaller apertures or ports 32 generally evenly spaced on each side of the rectangular opening 31. The function of these openings 31 and apertures or ports 32 with respect to the overall operation of the induction cooking cartridge 10 will be further discussed herein.

The pan-like container 16 is generally rectangular in shape, is formed from sheet metal and includes side and end walls 33 and 34 and a bottom wall 35 with an open top to form the cavity 17 as previously discussed. As shown in FIGS. 1–3, the side and end walls 33 and 34 each include a plurality of downwardly opening louvers 36 which define a primary air inlet to within the cavity 17. As best shown in FIGS. 3, the central section 39 of the bottom wall 35 and side walls 33 of the container 16 are necked down so that the width and height of the container 16 are reduced in that central section 39 as compared to the remainder of the container 16. As further shown in FIG. 2, an exhaust opening 40 is formed in the necked-down portion of the bottom wall 35 of the container 16. One end wall 34 of the container 16 is outwardly expanded to provide an area for mounting the male portion 41 of a quick connect bayonet type electrical connector. The female portion 42 of the electrical connector is mounted in a side wall 13 of the recess 11 in the cooking range.

Referring again to FIGS. 1 and 3 and to the top portion 15 of the induction cooking cartridge 10, each side of the frame-like member 22 includes a pair of rectangular tabs 43 which extend downwardly from and substantially perpendicular to the generally horizontal plane of the support flange 30. These rectagular tabs 43 have apertures which are aligned with similar apertures in the side walls 33 of the container 16 and which receive threaded fasteners 44 for attaching the top portion 15 of the induction cooking cartridge 10 to the side walls 33 of the container 16. As best shown in FIG. 2, when the top portion 15 is mechanically attached to the container 16, a vertical gap or space 45 is defined around the periphery of the container 16 in an area between the bottom side 46 of the ceramic cooking surface 23 and the top edge 49 of the side and end walls 33 and 34 of the container 16 for defining a secondary air inlet into the interior of the container 16.

The third main component of the induction cooking cartridge 10 is the panel or housing member 18. The panel or housing member 18 is a substantially U-shaped housing or collar which is formed from a thermoplastic material or from sheet metal. The panel or housing member 18, as shown in FIGS. 1–3, extends from side to side across the necked-down central section 39 of the bottom wall 35 of the container 16 and extends upwardly along each side wall 33 of the container 16. The bottom and sides 50 and 51 respectively of the panel or housing member 18 are formed so that they extend slightly beyond the maximum width and depth of the container 16 as shown in FIG. 2. The panel or housing member 18 is mechanically secured to the outside of the container 16 by threaded fasteners 52 which tap into the sides 33 of the container 16 as shown in FIGS. 1 and 3. As best shown in FIG. 2, the panel or housing member 18 covers and substantially surrounds the exhaust opening 40 in the bottom wall 35 of the container 16 and the upwardly extending sides 51 of the panel or housing member 18 terminate at approximately the vertical level of the horizontal support flange 30 and are in airflow communication with the rectangular openings 31 formed in the side walls 26 of the frame-like member 22 for directing exhaust to the kitchen environment above the top surface 12 of the range. The bottom wall 50 of the panel or housing member 18 also includes a pair of slotted openings 53, as shown in FIG. 2, for allowing drainage of any liquids which may enter the panel or housing member 18. The panel or housing member 18 in combination with the necked-down central section 39 of the container 16 and the rectangular openings 31 in the frame-like member 22 form the exhaust conduit 21 for conducting heated air from the exhaust opening 40 in the bottom wall 35 of the container 16 to the kitchen environment above the range.

As further shown in FIGS. 2 and 3, the vertical gap or space 45 formed around the periphery of the container 16 between the bottom side 46 of the ceramic cooking surface 23 and the top edge 49 of the side walls 33 of the container 16 is interrupted in the vicinity of rectangular openings 31 in the side walls 26 of the frame-like member 22 by a top air deflector 54 formed of sponge rubber or other resilient material placed in the gap 45 and held in position by a slight interference fit between the top edge 49 of the side walls 33 of the container 16 and the bottom side 46 of the ceramic cooking surface 23. Side air deflectors 55 of sponge rubber or the like are placed on each side of the rectangular openings 31 with the top and side deflectors 54 and 55 combining with the frame-like member 22, the container 16 and the panel or housing member 18 to effectively isolate the exhaust flow from the rectangular openings 31 and reduce the possibility of exhaust flow being short circuited back into the interior of the induction cooking cartridge 10.

Referring again to FIGS. 1–3, there are shown a plurality of spacers 56 secured to the bottom of the support flange 30. When the induction cooking cartridge 10 is in an operative posture, as shown in FIGS. 2 and 3, the spacers 56 elevate the bottom of the support flange 30 above the top surface 12 of the range and provide an airflow space or gap 57 all around the periphery of the induction cooking cartridge 10 to allow airflow into the recess 11 in addition to airflow through the apertures or ports 32. The spacers 56, in this embodiment of the invention, are formed of a thermoplastic or other dielectric material for electrically isolating the induction cooking cartridge from the top surface 12 of the range.

The rectangular openings 31 in the side walls 26 of the frame-like member 22 are located at approximately the balance point of the induction cooking cartridge 10 and provide hand holds for aiding in installation and removal of the induction cooking cartridge 10 into and out of the recess 11. It is further noted that the spacers 56 adjacent the connector end of the induction cooking cartridge 10 are tapered to assist in sliding the induction cooking cartridge 10 upon the top surface 12 of the housing during installation.

Figure 4:
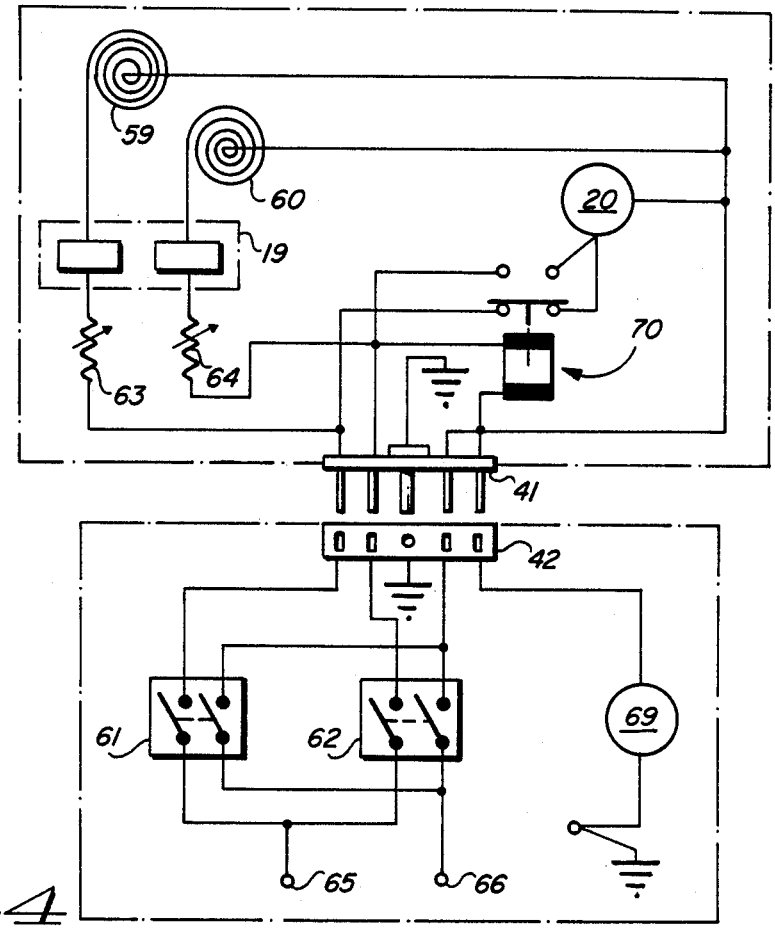
FIG. 4 is a schematic diagram of the electrical circuit for an induction cooking cartridge when used in a proximity ventilating range.

Turning now to FIGS. 3 and 4, as previously discussed, the male bayonet connector 41 is adapted to be received in a female bayonet connector 42. The individual induction heaters 59 and 60 which underlie the dashed line areas 24 and 25 are controlled in an on-off fashion by panel switches 61 and 62 which are interlocked with the cartridge fan 20 shown in FIG. 4. Regulated control of the induction heaters 59 and 60 is achieved through adjustment of infinitely variable switches 63 and 64.

The solid state circuitry for operating the induction heaters is generally designated 19 and is not illustrated herein since the components and details of their operation are not a part of this invention and are generally known in the art. The cartridge fan 20 which is interlocked with panel switches 61 and 62 is also located within the container 16 juxtaposed to the exhaust opening 40 in the bottom wall 35.

With the male bayonet connector 41 of the induction cooking cartridge 10 operatively received by the female bayonet connector 42, as illustrated in FIGS. 3 and 4, five electrical connections are established with the center connecting being to chassis ground. The induction cooking cartridge 10 is energized by 240 VAC as supplied between lines 65 and 66 by panel switches 61 and 62 which are double pole switches and serve an interlocked on-off function with respect to induction heaters 59 and 60 as well as to the cartridge fan 20 so that the cartridge fan 20 is on whenever switch 61 and/or 62 is on.

It is noted that the induction cooking cartridge 10 described herein is utilized in a range having proximity ventilation. Therefore, the proximity ventilation fan 69, shown schematically in FIG. 4, is shown as being energized whenever the induction cooking cartridge 10 is energized although this is not an essential characteristic of the system.

The relay 70, in the deenergized posture of FIG. 4, connects switch 61 to the cartridge fan 20. When switch 62 is closed the relay 70 is energized and connects switch 62 to the cartridge fan 20. When switches 61 and 62, or either of them, are closed, the power to the induction heaters 59 and 60 is variably controlled by infinitely variable switches 63 and 64. The solid state circuitry 19 produces a 25–30 kilohertz signal in the coils of the induction heaters 59 and 60 at an amperage dependent upon the position of switches 63 and 64, assuming switches 61 and 62 are on. If a cooking utensil of a proper material, such as iron, is located on the cooking surface 23 adjacent the coil of induction heater 59 or 60, a current is induced therein so that the cooking utensil acts as a burner to heat its contents.

As best illustrated in FIGS. 2 and 3, a definite cooling airflow pattern is established into and out of the induction cooking cartridge 10 whenever one or both of the induction heaters 59 or 60 are energized and the cartridge fan 20 is concurrently energized. Energization of the cartridge fan 20 will cause cooling air to be drawn into the recess 11 through the plurality of apparatus 32 in the side walls 26 of the frame-like member 22 and also through the airflow gap 57 around the periphery of the induction cooking cartridge 10 between the support flange 30 and the top surface 12 of the range. The cartridge fan 20 will pull the cooling air into the interior of the container 16 through the plurality of louvers 36 in the side and end walls 33 and 34 of the container 16 and also through the peripheral vertical gap or space 45 between the bottom side 46 of the cooking surface 23 and the top edge 49 of the container side walls 33. Once within the container 16, cooling air is directed over the solid state circuitry 19 and passes through the cartridge fan 20 and out the exhaust opening 40 to the exhaust conduit or duct 21. The heated air is forced through the exhaust conduit or duct 21 and out the rectangular openings 31 in the frame-like member 22 to the kitchen environment above the range as indicated by arrow 71 in FIGS. 1 and 3. A very small portion of the exhaust, indicated by arrows 72 in FIGS. 2 and 3, will be forced through the slotted openings 53 in the bottom of the exhaust duct 21 and will reenter the interior of the container 16 through the louvers 36.

Figure 5:
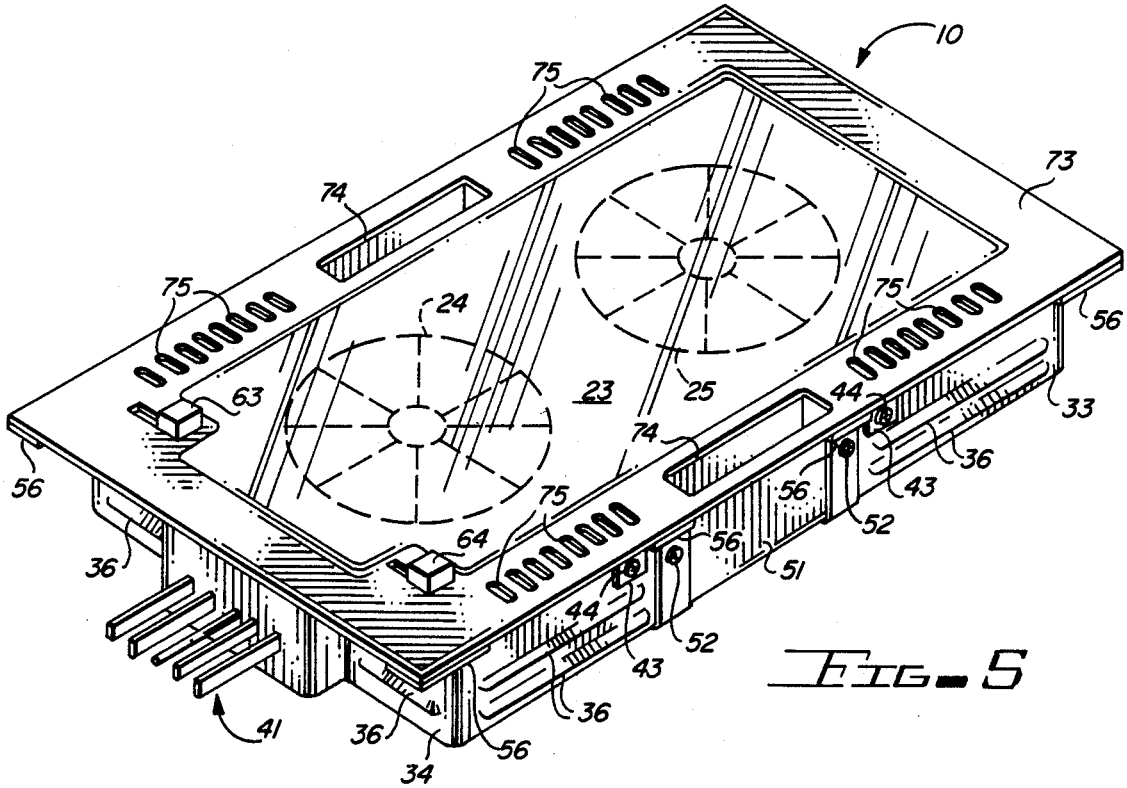
FIG. 5 is a view similar to FIG. 1 showing an alternate embodiment of the induction cooking cartridge unit.

FIG. 5 depicts an alternate embodiment of an induction cooking cartridge utilizing the airflow system of this invention. In this embodiment, the top portion of the induction cooking cartridge 10 has a frame-like member 73 for holding the ceramic cooking surface 23 which is designed so that the induction cooking cartridge 10 will be substantially flush with the top surface 12 of the cooking range. In this alternate embodiment of the invention, rectangular exhaust openings 74 and inlet openings 75 are upwardly opening and are formed as part of the frame-like member 73 as is the support flange. The airflow in this embodiment is similar to that of the preferred embodiment but the visible profile of the induction cooking cartridge is lower.

As a further alternate it is envisioned that the cooling airflow could be introduced on one side of the induction cooking cartridge 10 and exhausted on the opposite side of the induction cooking cartridge 10 through a single exhaust opening. Also, the panel or housing member 18 of the preferred embodiment could be modified so that it is mounted within the container 16 instead of on the outside.

There has been described herein an improved cooling system for an induction cooking cartridge. The cooling system describes a unique airflow path which includes air inlets to the mounting recess and airflow openings to within the cooking cartridge in both the upper and lower segments of the cooking cartridge. The airflow is directed across solid state circuitry associated with the induction heaters to effect cooling thereof and is exhausted out the bottom of the cooking cartridge into a U-shaped collar or housing which combines with the bottom and sides of the container to form an exhaust conduit for conducting heated air to the kitchen environment of the top surface of the range.

In the drawings and specification, there has been set forth a preferred embodiment of the invention and although specific terms are employed these are used in a generic and descriptive sense only and not for purposes of limitation. Changes in the form and the portion of parts as well as the substitution of equivalents are contemplated as circumstances may suggest or render expedient without departing from the spirit or scope of the invention as further defined in the following claims.

I claim:

1. A cooking appliance for selectively receiving a modular cooking cartridge, comprising: cabinet means defining an upwardly opening recess therein; modular cooking cartridge means including enclosure means having a top, a bottom wall and side walls defining a cavity; electrical heating means in said cavity, said enclosure means further including flange means extending substantially around the periphery thereof for supporting said modular cooking cartridge in an operative posture at least partially within said recess; air inlet means including a plurality of inlet ports associated with said enclosure means top and communicating with a first airflow path defined by said recess-defining cabinet means and said cavity-defining enclosure means to conduct ambient airflow into said cavity for cooling said electrical heating means; air outlet means including an outlet opening from said cavity with said outlet opening being defined by said cavity-defining enclosure means, exhaust housing means disposed between said recess-defining cabinet means and said cavity-defining enclosure means and cooperable with said enclosure means for effectively enclosing said outlet opening and defining a second airflow path for conducting heated exhaust air from said cavity, said second airflow path being an extension of said first airflow path and separated from said first airflow path in the area of said recess by said exhaust housing means, and an outlet port through said enclosure means top above said flange means in airflow communication with said second airflow path for conducting said exhaust air to ambient; and fan means associated with said outlet opening and operable for drawing cooling air into said cavity by way of said inlet ports and said first airflow path to effect heat transfer contact with said electrical means and for exhausting the heated cooling air out through said second airflow path and said outlet port.

2. A cooking appliance for selectively receiving a modular cooking cartridge as defined in claim 1 wherein said first airflow path includes a plurality of openings associated with said enclosure means side walls with at least a portion of the cooling air entering said recess prior to being drawn into said cavity.

3. A cooking appliance for selectively receiving a modular cooking cartridge as defined in claim 1 and further including spacer means secured to the bottom of said flange means for spacing the bottom of said flange means above said cabinetry to define an auxiliary inlet port to said recess.

4. A cooking appliance for selectively receiving a modular cooking cartridge as defined in claim 3 wherein said spacer means includes a plurality of pads formed of a dielectric material for electrically isolating said modular cooking cartridge from said cabinetry.

5. A cooking appliance for selectively receiving a modular cooking cartridge as defined in claim 3 wherein said spacer means includes two tapered spacers for sliding on said cabinetry as said enclosure means is installed in said recess.

6. A cooking appliance for selectively receiving a modular cooking cartridge as defined in claim 1 wherein said exhaust housing means is attached to the outside of said bottom and side walls of said enclosure means.

7. A cooking appliance for selectively receiving a modular cooking cartridge, comprising: cabinet means defining an upwardly opening recess therein; modular cooking cartridge means including enclosure means having a top, a bottom wall and side walls defining a cavity; electrical heating means in said cavity, said enclosure means further including flange means extending substantially around the periphery thereof and positioned below the top of said side walls for supporting said modular cooking cartridge in an operative posture at least partially within said recess and defining upper side walls and lower side walls; air inlet means including a plurality of inlet ports associated with said upper side walls and communicating with a first airflow path defined by said recess-defining cabinet means and said cavity-defining enclosure means to conduct ambient airflow into said recess; a plurality of openings in said lower side walls of said enclosure means forming a continuation of said first airflow path for admitting said ambient airflow from said recess to within the cavity of said enclosure means for cooling said electrical heating means; air outlet means including an outlet opening from said cavity with said outlet opening being defined by said cavity-defining enclosure means, exhaust housing means disposed between said recess-defining cabinet means and said cavity-defining enclosure means and including a substantially U-shaped portion effectively enclosing said outlet opening and cooperable with a narrowed portion of said lower side and bottom walls to form an exhaust conduit defining a second airflow path within said recess but isolated from said first airflow path for conducting heated exhaust air from said cavity, said air outlet means further including outlet ports spaced from said inlet ports in said upper side walls and in airflow communication with said exhaust conduit for conducting said heated exhaust air to ambient; and fan means adjacent said outlet opening from said cavity and operable for drawing cooling air into said recess through said inlet ports and said first airflow path, into said cavity through said plurality of openings, into cooling contact with said electrical heating means and for exhausting the heated cooling air out through said second airflow path and said outlet ports.

* * * * *

UNITED STATES PATENT AND TRADEMARK OFFICE

CERTIFICATE OF CORRECTION

PATENT NO. : 4,549,052

DATED : October 22, 1985

INVENTOR(S) : Donald J. Simon

It is certified that error appears in the above-identified patent and that said Letters Patent are hereby corrected as shown below:

| | |
|---|---|
| Col. 1, line 57 | "utilizng" should be -utilizing -- |
| Col. 1, line 66 | after "flange" insert -- and -- |
| Col. 3, line 24 | "well" should be -- end walls -- |
| Col. 5, line 37 | "connecting" should be -- connection -- |
| Col. 6, line 5 | "apparatus" should be -- apertures -- |
| Col. 7, line 39 | after "electrical" insert -- heating -- |

Signed and Sealed this

*Eighteenth* Day of *February 1986*

[SEAL]

*Attest:*

DONALD J. QUIGG

*Attesting Officer*

*Commissioner of Patents and Trademarks*